US008026033B2

(12) United States Patent
Kobayashi et al.

(10) Patent No.: US 8,026,033 B2
(45) Date of Patent: Sep. 27, 2011

(54) FERRITE CARRIER FOR ELECTROPHOTOGRAPHIC DEVELOPER AND ELECTROPHOTOGRAPHIC DEVELOPER

(75) Inventors: Hiromichi Kobayashi, Kashiwa (JP); Takao Sugiura, Kashiwa (JP); Kanao Kayamoto, Kashiwa (JP)

(73) Assignee: Powdertech Co., Ltd., Kashiwa-shi, Chiba (JP)

( * ) Notice: Subject to any disclaimer, the term of this patent is extended or adjusted under 35 U.S.C. 154(b) by 925 days.

(21) Appl. No.: 12/014,852

(22) Filed: Jan. 16, 2008

(65) Prior Publication Data

US 2008/0171281 A1 Jul. 17, 2008

(30) Foreign Application Priority Data

Jan. 16, 2007 (JP) ..... 2007-007046

(51) Int. Cl.
*G03G 9/00* (2006.01)

(52) U.S. Cl. ..... 430/111.31; 430/111.34

(58) Field of Classification Search ..... 430/111.31, 430/111.34
See application file for complete search history.

(56) References Cited

U.S. PATENT DOCUMENTS

2006/0127793 A1* 6/2006 Hotta et al. ..... 430/111.33

FOREIGN PATENT DOCUMENTS

| | | | |
|---|---|---|---|
| JP | 7225497 | A | 8/1995 |
| JP | 7333910 | A | 12/1995 |
| JP | 2001154416 | A | 6/2001 |
| JP | 2006154806 | A | 6/2006 |

OTHER PUBLICATIONS

Toshiro Sumita, "Iron Oxide for Ferrite (Ferrite You Sanka Tetsu, in Japanese)", pp. 175 to 177, 1992.

* cited by examiner

*Primary Examiner* — Mark Chapman
(74) *Attorney, Agent, or Firm* — Rothwell, Figg, Ernst & Manbeck, P.C.

(57) ABSTRACT

Disclosed are a ferrite carrier for electrophotographic developer and an electrophotographic developer using the ferrite carrier, wherein: the ferrite carrier is a composite ferrite composed of Li and Mg; when the composition of the ferrite is calculated as a mixture of a Li ferrite having a stoichiometric composition and a Mg ferrite having a stoichiometric composition, the excessive amount of $Fe_2O_3$ is less than 5 mol %, or the total excessive amount of $Li_2O$ and MgO is less than 1 mol %; the content of the elements other than Li, Mg, Fe and O is 2 % by weight or less; and further, the content of Mn in terms of element is 1000 to 9000 ppm.

6 Claims, No Drawings

FERRITE CARRIER FOR ELECTROPHOTOGRAPHIC DEVELOPER AND ELECTROPHOTOGRAPHIC DEVELOPER

TECHNICAL FIELD

The present invention relates to a ferrite carrier for electrophotographic developer wherein the ferrite carrier is light in specific gravity, high in electrical resistance, and small in the variations of various properties such as electrical resistance properties, magnetic properties and surface property, and an electrophotographic developer highly durable, highly reliable and low in image defects.

BACKGROUND ART

A two-component developer used in electrophotography is composed of a toner and a carrier. The carrier is a substance which is mixed and stirred with the toner in a developer box to give a desired charge to the toner and carries the charged toner onto an electrostatic latent image formed on a photoreceptor to form a toner image. The carrier is held by a magnet so as to remain on the developing roller after the toner image formation, and is made to return to the developer box where it is again mixed and stirred with fresh toner particles for repeated use over a certain period.

In contrast to the one-component developer, the two-component developer contains the carrier which has the functions such that the carrier stirs toner particles to give a desired charge to the toner particles and carries the toner. As a result, the two-component developer is excellent in controllability in designing developers, and hence is widely used in the fields of full color machines required to provide high image qualities and high-speed machines required to secure reliability and durability in image maintenance.

In such a two-component electrophotographic developer, for the purpose of obtaining high-quality images, particles of ferrites such as Cu—Zn ferrite and Ni—Zn ferrite have been used as carriers in place of oxide-coated iron powders and resin-coated iron powders. As compared to conventional iron powder carriers, ferrite carriers using such ferrite particles as described above are generally spherical and have many advantageous properties for obtaining high quality images such that the magnetic properties thereof are controllable. Further, resin-coated ferrite carriers prepared by coating such ferrite particles used as the carrier cores with various resins are improved in abrasion resistance, durability and the like, and make the volume resistivity controllable.

However, the conventional ferrite carriers containing heavy metals such as Cu, Zn and Ni currently tend to be avoided from the viewpoint of reduction of the load on the environment, regulations of waste, and others. Additionally, such heavy metal-containing ferrite carriers tend to have lower electrical resistance leading to a problem such that image defects are caused by leakage under high electric field. Further, there have been problems that such heavy metal-containing ferrite carriers are heavy in specific gravity and hardly capable of attaining high durability.

On the other hand, for the purpose of solving the above-described problems, some light metal-containing ferrite carriers have been disclosed. For example, Japanese Patent Laid-Open No. 2001-154416 describes an electrophotographic carrier using a magnesium-containing ferrite; additionally, Japanese Patent Laid-Open No. 7-225497 discloses a ferrite carrier for electrophotographic developer using a lithium-containing ferrite and a developer using the carrier; further, Japanese Patent Laid-Open No. 7-333910 discloses a ferrite carrier for electrophotographic developer using a lithium-containing ferrite which is partially substituted with an alkali earth metal oxide (MgO, CaO, SrO or BaO) and a developer using the carrier.

However, these light metal-containing ferrite carriers suffers from a problem such that the magnetization variation and electrical resistance variation among particles tend to be generated, and accordingly tend to cause image defects such as carrier adhesion when used in electrophotographic developers. Specifically, as disclosed in Japanese Patent Laid-Open No. 2001-154416, a ferrite carrier containing only magnesium as a main component degrades the saturation magnetization. On the other hand, when the saturation magnetization is enhanced by developing a magnetite phase through excessively mixing iron oxide and sintering in a reductive atmosphere, the electrical resistance is drastically decreased to induce carrier adhesion.

Additionally, as disclosed in Japanese Patent Laid-Open No. 7-225497, a ferrite carrier containing a large amount of lithium tends to give a large magnetization variation among particles.

Japanese Patent Laid-Open No. 7-333910 discloses a carrier for electrophotographic developer excellent in image quality and durability, benign to the environment, long in life and excellent in environmental stability, wherein the carrier is prepared by substituting part of $Li_2O$ and/or $Fe_2O_3$ in a lithium-containing ferrite with an alkali earth metal oxide such as MgO, CaO, SrO or BaO. However, such substitution creates a part to be a hard ferrite substituted with CaO, SrO or BaO, and consequently the remanent magnetization and the coercive force are increased to degrade the fluidity, and the surface property variation tends to be generated.

Additionally, in Example 2 and Example 3 in Japanese Patent Laid-Open No. 7-333910, examples of composite ferrites containing Li and Mg. As described below, lithium is a monovalent metal and Mg is a divalent metal, and hence the Li ferrite is present in a form of $(Li_2O)(Fe_2O_3)_5$ and the Mg ferrite is present in a form of $(MgO)(Fe_2O_3)$; accordingly, in the ferrite of above Example 2, it is assessed that $(Fe_2O_3)$ is present in excess by approximately 7 mol %.

Similarly, the composition of above Example 3 is assessed to contain $(Li_2O)$ in excess by approximately 1.9 mol %, or $(Li_2O)$ and (MgO) in excess by approximately 5.7 mol % in total.

Further, Japanese Patent Laid-Open No. 7-333910 discloses an example (Comparative Example 20) in which Mn is contained in a Li-containing ferrite; however, as shown in the evaluation results of Japanese Patent Laid-Open No. 7-333910, the scattered amount is abnormally large, so that such a ferrite is far from a practically usable level. However, in contrast to the present invention, Japanese Patent Laid-Open No. 7-333910 does not present any disclosure or suggestion with respect to the effect and the appropriate content range of Mn contained in a trace amount.

An attempt to solve the above-described problems has been made by containing a trace amount of a heavy metal element in these light metal-containing ferrite carriers. Japanese Patent Laid-Open No. 2006-154806 describes a carrier having a coating layer and a carrier core containing 10 to 40 mol % of a metal oxide containing at least one metal element selected from the group consisting of magnesium, lithium and calcium and containing 50 to 4000 ppm, in terms of the total sum, of a metal oxide containing at least one metal element selected from the group consisting of manganese, copper, chromium and zinc.

However, even by controlling the elements, described in Japanese Patent Laid-Open No. 2006-154806, used in wide ranges and the contents thereof, and the contents of trace components, the carriers thus obtained hardly fulfill the high-level requirements in the image formation using recent electrophotography. In Examples of Japanese Patent Laid-Open No. 2006-154806, the "carrier 1," "carrier 13," "carrier 14," and "carrier 20" are disclosed as the carriers using the "carrier core 1." As can be seen from the results obtained for Examples and Comparative Examples using these carriers, no sufficient properties can be obtained depending on the fine particles contained in the coating resin even by using the carrier core materials evaluated to have sufficiently satisfactory compositions in Japanese Patent Laid-Open No. 2006-154806.

For example, the "carrier core 1" in Japanese Patent Laid-Open No. 2006-154806 is a ferrite containing Li and Mg as main components and is described to be composed of LiO: 12.9 mol %, MgO: 6.5 mol % and $Fe_2O_3$: 80.6 mol %. As described above, lithium is a monovalent metal and Mg is a divalent metal, and hence the Li ferrite is present in a form of $(Li_2O)(Fe_2O_3)_5$ and the Mg ferrite is present in a form of $(MgO)(Fe_2O_3)$; accordingly, even if LiO (divalent Li) is used to give the above described composition, it is assessed that $(Fe_2O_3)$ is present in excess by approximately 42 mol %.

Similarly, the "carrier core 3" in Japanese Patent Laid-Open No. 2006-154806 leads to an assessment that $(Li_2O)$ is contained in excess by 6 mol %, or $(Li_2O)$ and (MgO) are contained in excess by 15 mol % in total.

Such ferrites largely deviating from the stoichiometric compositions are hardly controllable in electrical resistance, and tend to undergo generation of the magnetic property variation and the surface property variation among particles, and hence, even by controlling other trace components, no sufficient properties can be obtained.

According to the description on p. 177 of "Iron Oxide for Ferrite (Ferrite You Sanka Tetsu, in Japanese)" by Toshiro Sumita, pp. 175 to 177, the manganese contents of the JIS first to third types of iron oxide are 0.30% by weight or less. Thus, the content of manganese as a concomitant impurity in the generally commercially available iron oxide can be found to be 3000 ppm or less.

Recently, in two-component electrophotographic developers, acceleration of the development performance and full-color development are strongly required. Among such requirements, higher durability and higher reliability are demanded, and no generation of image defects is also demanded.

Examples of the factors for improving the durability of electrophotographic developers include the light specific gravity of the carrier. Additionally, for the purpose of attaining high reliability, small variations among carrier particles are required for various properties such as the electrical resistance properties, magnetic properties and surface property. For the purpose of preventing the generation of image defects, it is required that the carrier be high in electrical resistance and no leakage be generated even in a high electric field. None of the ferrite carriers described in the above-described patent documents meets these requirements.

DISCLOSURE OF THE INVENTION

Problems to be Solved the Invention

Accordingly, an object of the present invention is to provide a ferrite carrier for electrophotographic developer light in specific gravity, high in electrical resistance and small in the variations of various properties such as electrical resistance properties, magnetic properties and surface property, and an electrophotographic developer high in durability, high in reliability and low in image defects.

Means for Solving the Problems

Under these circumstances, the present inventors have developed a study to solve these problems, and have achieved the present invention by discovering that the above-described objects can be attained by using as a carrier a lithium-magnesium-containing composite ferrite having specified composition ratios and by containing a specified amount of manganese in the ferrite.

The above-described ferrite carrier for electrophotographic developer according to the present invention is a composite ferrite containing Li and Mg, and is characterized in that when the composition of the ferrite is calculated as a mixture of a Li ferrite having a stoichiometric composition and a Mg ferrite having a stoichiometric composition, the excessive amount of $Fe_2O_3$ is less than 5 mol %, or the total excessive amount of $Li_2O$ and MgO is less than 1 mol %; the content of the elements other than Li, Mg, Fe and O is 2% by weight or less; and further, the content of Mn in terms of element is 1000 to 9000 ppm.

In the above-described ferrite carrier for electrophotographic developer according to the present invention, the above-described content of Li is preferably 0.60 to 1.65% by weight.

In the above-described ferrite carrier for electrophotographic developer according to the present invention, the specific surface area of the core material before coating a resin is preferably 0.05 to 0.70 $m^2/g$.

The above-described ferrite carrier for electrophotographic developer according to the present invention preferably has the surface thereof coated with a resin.

The above-described ferrite carrier for electrophotographic developer according to the present invention preferably has a volume average particle size of 20 to 50 μm, a number average particle size of 15 to 40 μm, a content of the particles of less than 24 μm in particle size of 5% by volume or less, a true density of 3.0 to 5.0 $g/cm^3$, and an apparent density of 1.0 to 2.2 $g/cm^3$.

The present invention also provides an electrophotographic developer composed of the above-described ferrite carrier and a toner.

ADVANTAGE OF THE INVENTION

The ferrite carrier for electrophotographic developer according to the present invention is a lithium-magnesium-containing composite ferrite having a specific composition ratio and containing a specific amount of manganese, and hence is light in specific gravity, high in electrical resistance and small in the variations of various properties such as electrical resistance properties, magnetic properties and surface property. Additionally, the electrophotographic developer, according to the present invention, using this ferrite carrier is high both in durability and in reliability, and hardly generates image defects.

BEST MODE FOR CARRYING OUT THE INVENTION

Hereinafter, embodiments of the present invention will be described.

<Ferrite Carrier for Electrophotographic Developer According to the Present Invention>

The ferrite carrier for electrophotographic developer according to the present invention is a composite ferrite containing Li and Mg, and is characterized in that when the composition of the ferrite is calculated as a mixture of a Li ferrite having a stoichiometric composition and a Mg ferrite having a stoichiometric composition, the excessive amount of $Fe_2O_3$ is less than 5 mol %, or the total excessive amount of $Li_2O$ and MgO is less than 1 mol %; the content of the elements other than Li, Mg, Fe and O is 2% by weight or less; and further, the content of Mn in terms of element is 1000 to 9000 ppm.

When the excessive content of $Fe_2O_3$, $Li_2O$ and MgO falls within the above described range as described above, the ferrite carrier has a composition close to the stoichiometric composition ratio, and hence can be high in electrical resistance, can attain a desired saturation magnetization, and can suppress the magnetization variation among particles. When the content of $Fe_2O_3$ is excessive, part of $Fe_2O_3$ can be converted into $Fe_3O_4$ by controlling the sintering conditions and hence the spontaneous magnetization can be developed; however, when the content of $Fe_2O_3$ exceeds 5 mol %, unpreferably the electrical resistance becomes too low. On the other hand, when the content of $Li_2O$ and MgO is excessive to exceed 1 mol %, unpreferably the magnetization variation among particles tends to become large, and the proportion of the nonmagnetic portion becomes large to cause the failures such as carrier adhesion.

The ferrite carrier for electrophotographic developer according to the present invention contains Mn in a content of 1000 to 9000 ppm in terms of element. By containing such an amount of Mn, ferrite particles high in electrical resistance and small in the variations of various properties such as the electrical resistance properties, magnetic properties and surface property can be obtained. As described in the above-described non-patent document "Iron Oxide for Ferrite," the iron oxide to be the raw material for ferrites usually contains Mn as an impurity. Available is iron oxide purified as a special grade chemical so as to have a high purity, but it is substantially difficult to use such iron oxide industrially and commercially. Accordingly, when ferrite particles are prepared according to the above-described composition ratio, there is a possibility that Mn is contained at most in an amount of approximately 3000 ppm as a concomitant impurity (inevitable impurity), and the content of Mn is varied depending on the raw material lot to be used. Such variation significantly affects the properties of the ferrite particles, and accordingly it is important how accurately the content of Mn is controlled while considering the concomitant impurities (inevitable impurities) contained in the iron oxide used as the raw material. It is industrially difficult to control the content of Mn so as to be less than 1000 ppm. When the content of Mn exceeds 9000 ppm, unpreferably the variations of the magnetic properties, electrical resistance properties and surface property among particles tend to be caused.

The ferrite carrier for electrophotographic developer according to the present invention is a composite ferrite containing Li and Mg in a specified composition ratio, and provides satisfactory properties due to the conditions that the excessive contents of $Fe_2O_3$, $Li_2O$ and MgO each fall within a specific range, the content of the elements other than Li, Mg, Fe and O is 2% by weight or less, and a specific amount of Mn is contained. The reason for this is conceivably as follows.

Specifically, Li is usually a monovalent metal, and forms a 1-3 spinel when the Li-containing ferrite takes a spinel structure. In contrast to the general 2-3 spinel ferrite containing as a main component a divalent metal such as Cu, Ni or Zn, such a 1-3 spinel ferrite is characterized by enabling obtaining high electrical resistance and by others. Mg is a divalent metal and forms a 2-3 spinel when the Mg-containing ferrite takes a spinel structure. The structure of the ferrite containing Ca is hardly identifiable, and many documents report that the Ca-containing ferrite takes a magnet-plumbite structure instead of a spinel structure; additionally, the magnet-plumbite ferrite is identified to take several different structures.

Further, as described above, Sr and Ba each are an element which takes a magnet-plumbite structure to give a hard ferrite.

A comparison of the cation configuration of Li and that of Mg reveals that almost all the Li cations each take the A position to form a normal spinel, but the Mg cations take not only the A positions but partially the B positions (inverse spinel) to give an intermediate type between the normal spinel and the inverse spinel. However, most of the Mg cations are said to take the A-positions (normal spinel).

On the other hand, the cation configuration of Mn is of an intermediate type in which the Mn cations take both of the A and B positions. Most of the Mn cations are said to take the B-positions. Additionally, Mn takes many forms including divalent, trivalent, tetravalent and heptavalent forms, so that the structure of a Mn-containing ferrite is diversified.

In a ferrite, the cation configuration as described above and the control of the electrovalency are extremely important. In particular, when a ferrite is used as the ferrite carrier for electrophotographic developer, if the variations of the cation configuration and the valency control are generated among particles, such variations become the causes of the variations of the magnetic properties, electrical resistance properties and surface property among particles, and consequently become the causes of image defects.

In view of the above-described technical background, it can be said that, for the purpose of stably producing a ferrite having a specific structure of Li ferrite without suffering from variations between particles, it is extremely important to control highly accurately the elements which fluctuate the ion configuration and the electrovalency.

In other words, preferable is a ferrite in which Mn, Sr, Ca or Ba which has valency variation and is different in the cation configuration and structure is substantially not contained, but Li and Mg which are hardly varied in valency and tend to take the A-positions are contained as the main components so as to be combined without causing large deviation from the stoichiometric composition.

For the purpose of attaining the above-described object, it can be said to be extremely important to consider and control highly accurately the content of Mn contained as an impurity in iron oxide from the industrial and commercial standpoint.

In particular, as a result of a diligent study which has been made in order to obtain such properties as suitable for use as a ferrite carrier for electrophotographic developer, a ferrite having a composition constrained to fall within such a specific and extremely narrow range as described above has been found preferable.

In the ferrite carrier for electrophotographic developer according to the present invention, the content of Li is preferably 0.60 to 1.65% by weight.

When the content of Li is less than 0.60% by weight, the properties of Mg ferrite tends to be dominant and the saturation magnetization tends to be degraded. When the content of Li exceeds 1.65% by weight, the properties of Mg ferrite vanish and the electrical resistance tends to be low, and unpreferably, the variations among particles tend to be generated because the content of Mg is small.

The specific surface area of the ferrite carrier for electrophotographic developer according to the present invention is preferably 0.05 to 0.70 $m^2/g$.

When the specific surface area of the ferrite carrier is too small, no effective charged area is obtained; when the specific surface area of the ferrite carrier is too large, uniform surface property is hardly obtainable; and thus, unpreferably both of the too small and too large specific surface areas tend to cause image defects. Additionally, when the specific surface area of the ferrite carrier is too small, the coating resin cannot be sufficiently held, so that the excessive resin is isolated as the case may be in the resin coating step, so as to be a cause of image defects such as white spots.

The ferrite carrier for electrophotographic developer according to the present invention preferably has the surface thereof coated with a resin. The coating amount of the resin is preferably 0.1 to 20% by weight in relation to the carrier core material (ferrite carrier). When the coating amount is less than 0.1% by weight, it is difficult to form a uniform coating layer on the carrier surface, and when the coating amount exceeds 20% by weight, the carrier particles undergo mutual agglomeration.

Depending on the surface property and voids of the ferrite particles, part of the above-described coating resin penetrates into the ferrite particles as the case may be, but the content of the penetrating resin can be appropriately controlled.

The resin to be coated is not particularly limited, and various types of resins can be used. For a positively charged toner, there can be used, for example, fluororesin, fluorine-acrylic resin, silicone resin and modified silicone resin. On the other hand, for a negatively charged toner, there can be used, for example, acrylic resin, acryl-styrene resin, a mixed resin composed of acryl-styrene resin and melamine resin and a cured resin thereof, silicone resin, modified silicone resin, polyester resin, epoxy resin, urethane resin and polyethylene resin.

Additionally, according to need, there may be added a charge controlling agent, an adhesion-improving agent, a primer treatment agent or an electrical resistance controlling agent. Examples of the charge controlling agent and the electrical resistance controlling agent include various silane coupling agents, various titanium coupling agent, conductive carbon, borides such as titanium boride, and oxides such as titanium oxide, iron oxide, aluminum oxide, chromium oxide and silicon oxide; however, the charge controlling agent and the electrical resistance controlling agent are not particularly limited.

The ferrite carrier or resin coated ferrite carrier for electrophotographic developer according to the present invention preferably has a volume average particle size of 20 to 50 μm, a number average particle size of 15 to 40 μm, a content of the particles less than 24 μm in particle size of 5% by volume or less, a true density of 3.0 to 5.0 g/cm$^3$, and an apparent density of 1.0 to 2.2 g/cm$^3$.

When the volume average particle size is less than 20 μm or the number average particle size is less than 15 μm, unpreferably the carrier adhesion tends to occur even if the ferrite composition or the content of Mn is highly accurately controlled to suppress the variations among particles. On the other hand, when the volume average particle size exceeds 50 μm or the number average particle size exceeds 40 μm, unpreferably the image quality tends to be degraded even if the ferrite composition or the content of Mn is highly accurately controlled to prepare ferrite particles high in electrical resistance and free from the variation of the electrical resistance among particles.

Further, when the true density or the apparent density is too low, the fluidity of the developer is degraded and the charge rise characteristics are degraded, and when the true or apparent density is too high, the stress exerting on the toner becomes too strong; and thus, unpreferably both of the two low and too high true or apparent density makes it difficult to maintain high image quality over a long period of time.

<Method for Producing the Ferrite Carrier for Electrophotographic Developer According to the Present Invention>

Next, a preferable method for producing the ferrite carrier for electrophotographic developer according to the present invention will be described.

First, ferrite raw materials (iron oxide, a lithium compound, a magnesium compound and a manganese compound) are appropriately weighed out so as to give a predetermined composition, and then pulverized and mixed together with a ball mill, a vibration mill or the like for 0.5 hour or more, preferably for 1 to 20 hours. The thus pulverized mixture was added with water to be converted into a slurry and then the slurry is granulated by using a spray dryer. Then, the granulated substance is calcined, then pulverized to prepare a slurry. The slurry is again granulated by using a spray dryer to prepare a spherical granulated substance. It is to be noted that when the apparent density is desired to be decreased, the calcining step may be omitted.

After the calcining, the calcined substance is further pulverized by using a ball mill, a vibration mill or the like, and then added with water and, according to need, a dispersant, a binder and the like, adjusted in the viscosity, granulated, controlled in the oxygen concentration, and maintained for sintering at temperatures of 1000 to 1500° C. for 1 to 24 hours. When pulverization is made after calcining, the calcined substance may be added with water and pulverized by using a wet ball mill, a wet vibration mill or the like.

The sintered substance obtained by the sintering is disintegrated and classified by using as the classification method an existing method such as a pneumatic classification method, a mesh filtration method, a settling method or the like. Thus, a ferrite carrier having a particle size controlled to a desired value is obtained.

Thereafter, according to need, the surface of the ferrite carrier may be subjected to an oxide film formation treatment based on a low-temperature heating to adjust the electrical resistance. For the oxide film formation treatment, a popular rotary electric furnace, a popular batch electric furnace or the like is used, and the heat treatment is conducted, for example, at 300 to 700° C. The thickness of the oxide film formed by this treatment is preferably 0.1 to 5 μm. When the thickness is less than 0.1 μm, the effect of the oxide film is small, and when the thickness exceeds 5 μm, the magnetization is degraded or the electrical resistance becomes too high, and thus a problem such that the developing power is degraded tends to be caused. Additionally, according to need, reduction may be conducted before the oxide film formation treatment.

For the purpose of highly accurately controlling the content of Mn as claimed in the present invention, it is desirable to measure and identify the composition and the content of Mn by means of ICP in each of the steps precedent to the sintering.

When the content of Mn is too large or too small, in each of the steps precedent to the sintering, iron oxide, the Li raw material, the Mg raw material or the Mn raw material can be added in appropriate amount for adjustment.

Next, according to need, the surface of the thus obtained ferrite carrier (carrier core material) is coated with a resin. The method for coating resin is generally such that a resin is dissolved in a solvent and the surface of the above-described carrier core material is coated with the solution thus obtained. The coating amount and the type of the resin are as described above. For resins soluble in organic solvents, examples of the solvent to be used in this coating include toluene, xylene, cellosolve butyl acetate, methyl ethyl ketone, methyl isobutyl ketone and methanol; and for water-soluble resins or emulsion-forming resins, water can be used as the solvent. The coating can be conducted by using, as the method for coating such coating resin as described above on the above-described carrier core material, heretofore known methods such as a brush coating method, a dry coating method, a spray dry method based on fluid bed, a rotary dry method and a liquid immersion dry method using a versatile stirrer. For the purpose of improving the coating rate, the method based on fluid bed is preferable.

When baking is conducted after the resin is coated on the carrier core material, any of an external heating method and an internal heating method may be used. For example, the baking may be conducted by using a fixed or fluidized electric furnace, a rotary electric furnace, or a burner furnace, or by using microwave. The baking temperature is different depending on the resin used. However, the baking temperature is required to be equal to or higher than the melting point or the glass transition point of the resin. When a thermosetting resin, a condensation crosslinked resin or the like is used, it is necessary to elevate the baking temperature to such a level that allows the curing to proceed to a sufficient extent.

After a resin is coated and baked on the surface of the carrier core material, the resulting substance is cooled, disintegrated and subjected to size control to yield a resin-coated ferrite carrier.

<Electrophotographic Developer According to the Present Invention>

The ferrite carrier for electrophotographic developer according to the present invention, obtained as described above, is mixed with a toner and used as a two-component developer.

The toner to be used in the present invention can be produced by a heretofore known method such as the suspension polymerization method, the emulsion coagulation method, the ester extension polymerization method and the pulverizing method. For example, the toner is produced as follows: a binder resin, a coloring agent, a charge controlling agent and the like are fully mixed together with a mixer such as a Henschel mixer, the mixture thus obtained is melt-kneaded with a twin-screw extruder or the like for uniform dispersion, the melt-kneaded mixture is cooled and then finely pulverized with a jet mill or the like, classified with a pneumatic classification machine or the like, and thus a toner having a desired particle size can be obtained. According to need, wax, a magnetic powder, a viscosity modifier and other additives may be added to the toner. Further, after classification, an external additive or the like may also be added.

The binder resin used in the above-described toner is not particularly limited. As such binder resin, the following resins can be used each alone or as mixtures thereof according to need: polystyrene, chloropolystyrene, styrene-chlorostyrene copolymer, styrene-acrylate copolymer and styrene-methacrylate copolymer, and further resins such as rosin-modified maleic acid resin, epoxy resin, polyester resin, polyethylene resin, polypropylene resin, polyurethane resin and silicone resin.

Examples of the charge controlling agent usable in the above-described toner include nigrosine dyes, quaternary ammonium salts, organometallic complexes, chelate complexes and metal-containing monoazo dyes.

As the coloring agent used in the above-described toner, heretofore known dyes and/or pigments can be used. For example, carbon black, phthalocyanine blue, permanent red, chrome yellow, phthalocyanine green and the like can be used.

As the other additives, silica, titanium oxide, barium titanate, and fine particles obtained by modifying the surface of the particles of these compounds with organic compounds, fluorocarbon resin fine particles, acrylic resin fine particles and the like can be used each alone or in combination.

<Measurement Methods>

The measurement methods of the individual properties of the above-described ferrite carrier and the developer using the above-described carrier, according to the present invention, are described below.

(Volume Average Particle Size, Number Average Particle Size, and the Content of the Particles of Less Than 24 μm in Particle Size)

The volume average particle size, number average particle size, and the content of the particles of less than 24 μm in particle size were measured by using a microtrack particle size distribution analyzer 9320 HRA (X100) manufactured by Nikkisou Co., Ltd. Water was used as the dispersion medium. The particle refraction index was set at 1.81 for measurement. It is to be noted that the sample was directly placed in the measurement apparatus without particularly conducting any dispersion with aid of a dispersant or an ultrasonic homogenizer.

(Electrical Resistance)

Nonmagnetic parallel flat plate electrodes (10 mm×40 mm) was made to face each other with an electrode separation of 1.0 mm, and 200 mg of a weighed sample was packed between the electrodes. By attaching a magnet (the surface magnetic flux density: 1500 Gauss, the magnet area in contact with the electrode: 10 mm×30 mm) to the parallel flat plate electrodes, the sample was held between the electrodes. By sequentially applying voltages of 50 V, 100 V, 250 V, 500 V and 1000 V, the electrical resistance for each of these voltages was measured with an insulation resistance meter (SM-8210, manufactured by DKK-TOA Corporation). The measurement was carried out in a constant-temperature, constant-humidity room set at a room temperature of 25° C. and a humidity of 55%.

(Magnetic Properties)

The magnetization was measured by using an integral-type B—H tracer BHU-60 (manufactured by Riken Denshi Co., Ltd.). An H coil for measuring magnetic field and a 4πI coil for measuring magnetization were put in between electromagnets. In this case, a sample was put in the 4πI coil. The outputs of the H coil and the 4πI coil observed when the magnetic field H was varied by varying the current of the electromagnets each were integrated; and with the H output as the X-axis and the 4πI coil output as the Y-axis, a hysteresis loop was drawn on a chart. The measurement conditions were as follows: the sample filling quantity was approximately 1 g; the sample filling cell had an inner diameter of 7 mmϕ±0.02 mm and a height of 10 mm±0.1 mm; and the number of turns of the 4πI coil was 30.

(Apparent Density)

The apparent density was measured in conformity with JIS-Z2504 (test method of apparent density of a metal powder).

(True Density)

The true density of a carrier core material and the true density of a carrier particle after filling were measured in conformity with JIS R9301-2-1 by using a pycnometer. Here, methanol was used as the solvent and the measurement temperature was 25° C.

(Specific Surface Area)

The specific surface area can be derived from the amount of $N_2$ adsorbed by the carrier particles measured by adsorbing $N_2$ as an adsorption gas with "an automatic specific surface area measuring apparatus GEMINI 2360" (manufactured by Shimadzu Corporation).

It is to be noted that, in the present invention, the measuring tube to be used for measuring the $N_2$ adsorption amount was heated under a reduced pressure at 50° C. for 2 hours before measurement. The measuring tube was filled with 5 g of carrier particles, and pretreated under a reduced pressure at 30° C. for 2 hours, and thereafter the adsorption amount was measured by adsorbing $N_2$ gas at 25° C. The adsorption amount was a value derived by drawing an adsorption isotherm and using the BET equation.

(Surface Property Variation Among Particles)

The shape and the surface property of the carrier particles are identified by the observation with a scanning electron microscope (JSM-6100, manufactured by JEOL Ltd.) at an applied voltage of 20 kV and at a magnification of 450.

The evaluation was carried out on the basis of the following standards:

◎: Substantially no surface property variation among particles was found.

○: Small surface property variation among particles was found.

Δ: Large surface property variation among particles was found.

×: Extremely large surface property variation among particles was found.

(Scattering Test)

The carrier core material or the resin-filled carrier was magnetically held on a cylindrical sleeve having an area which has a peak magnetic flux density of 100 mT in the direction perpendicular to the axis. Only the magnetic pole area having the above-described peak magnetic flux density was opened, the cylindrical sleeve was rotated for 10 minutes to impart a detaching force three time as large as the gravitational force in the direction perpendicular to the rotation axis, and thus the amount detached from the opened portion was defined as the scattered amount. A large scattered amount means that the carrier tends to detach from the magnet roll in practical applications, and leads to problems such that the photoreceptor is damaged by the carrier scattering and white spots are generated. The scattered amount is preferably 50 mg or less, and more preferably 30 mg or less.

(Contents of Mn and Li, and Contents of the Elements Other Than Fe, Mg, Li and O)

A solution prepared by dissolving ferrite particles in hydrochloric acid was subjected to a measurement with an ICP analyzer (ICPS-1000IV, manufactured by Shimadzu Corporation).

Hereinafter, the present invention will be described specifically on the basis of Examples and others.

EXAMPLE 1

Raw materials were weighed out so as to give the composition composed of $Li_2O$: 15 mol %, MgO: 5 mol % and $Fe_2O_3$: 80 mol %. Lithium carbonate was used as the Li raw material, and magnesium hydroxide was used as the Mg raw material. The $Fe_2O_3$ used herein contained Mn in a content of 2700 ppm in terms of element, and Mn was anticipated to be contained in the ferrite in a content of approximately 2600 ppm when mixed according to the above-described composition.

These raw materials were mixed with water, and were pulverized for 2 hours with a wet media mill to prepare a slurry. The obtained slurry was dried at 120° C., and then the content of Mn was measured by ICP to give a content of Mn of 2500 ppm. The slurry thus obtained was dried with a spray dryer to obtain spherical particles. The particles were subjected to particle size control, and then heated at 800° C. for 2 hours for calcining. Then, the particles were pulverized for 1 hour with a wet ball mill by using stainless steel beads of ⅛ inch in diameter, and further pulverized for 4 hours by using stainless steel beads of 1/16 inch in diameter. The slurry thus obtained was added with an appropriate amount of dispersant, and added with PVA as a binder in an amount of 1% by weight in relation to the solid content of the slurry for the purpose of securing the strength of the granulated particles. Then the slurry was granulated and dried with a spray dryer, and maintained in an electric furnace at 1100° C. with an oxygen concentration of 0% by volume for 4 hours for the sintering. Thereafter the substance subjected to sintering was disintegrated and further classified for particle size control, and subjected to removal of low magnetic strength portions by magnetic separation to yield a core material for ferrite particles.

A resin solution was prepared by dissolving 1000 parts by weight of a condensation crosslinked silicone resin (SR-2411, manufactured by Toray Dow Corning Silicone Co., Ltd.) in terms of solid content and 100 parts by weight of γ-aminopropyltriethoxysilane in 1000 parts by weight of toluene. In a single screw indirect heating dryer, 10000 parts by weight of the obtained ferrite core material was placed, and the above-described resin solution was added dropwise to the ferrite core material under stirring while the temperature was being maintained at 75° C. After the toluene was checked to be sufficiently evaporated, the mixture in the dryer was increased in temperature up to 200° C. under stirring, and maintained at 200° C. for 2 hours. Thereafter, the thus dried substance was taken out from the dryer, coagulated particles were crushed and subjected to particle size control, and thereafter subjected to removal of low magnetic strength portions by magnetic separation to yield resin-coated ferrite carrier particles.

EXAMPLE 2

Resin-coated ferrite carrier particles were obtained in the same manner as in Example 1 except that the raw materials were weighed out so as to give the composition composed of $Li_2O$: 12.5 mol %, MgO: 12.5 mol % and $Fe_2O_3$: 75 mol %.

EXAMPLE 3

Resin-coated ferrite carrier particles were obtained in the same manner as in Example 1 except that the raw materials were weighed out so as to give the composition composed of $Li_2O$: 10 mol %, MgO: 20 mol % and $Fe_2O_3$: 70 mol %.

EXAMPLE 4

Raw materials were weighed out so as to give the composition composed of $Li_2O$: 15 mol %, MgO: 5 mol % and $Fe_2O_3$: 80 mol %. Lithium carbonate was used as the Li raw material, and magnesium hydroxide was used as the Mg raw material. The $Fe_2O_3$ used herein contained Mn in a content of 2800 ppm in terms of element, and Mn was anticipated to be contained in the ferrite in a content of approximately 2600 ppm when mixed according to the above-described composition. Accordingly, trimanganese tetraoxide was added in an amount of 0.75 part by weight to 100 parts by weight of the above-described composition. These raw materials were mixed with water, and were pulverized for 2 hours with a wet media mill to prepare a slurry. The thus obtained slurry was dried with a spray dryer to obtain spherical particles. The particles were subjected to particle size control, and then heated at 800° C. for 2 hours for calcining. Then, the particles were pulverized for 1 hour with a wet ball mill by using stainless steel beads of ⅛ inch in diameter, the obtained slurry was dried at 120° C., and the content of Mn was measured by ICP to reveal that the content of Mn was 4400 ppm. The particles were further pulverized for 4 hours by using stainless steel beads of 1/16 inch in diameter. The slurry thus obtained was added with an appropriate amount of dispersant, and added with PVA as a binder in an amount of 1% by weight in relation to the solid content of the slurry for the purpose of securing the strength of the granulated particles. Then the slurry was granulated and dried with a spray dryer, and maintained in an electric furnace at 1100° C. with an oxygen concentration of 0% by volume for 4 hours for the sintering. Thereafter the substance subjected to sintering was disintegrated and further classified for particle size control, and subjected to removal of low magnetic strength portions by magnetic separation to yield a core material for ferrite particles.

Resin-coated ferrite carrier particles were obtained in the same manner as in Example 1 in the step for resin coating and thereafter.

COMPARATIVE EXAMPLE 1

Raw materials were weighed out so as to give the composition composed of $Li_2O$: 13.3 mol %, MgO: 6.7 mol % and $Fe_2O_3$: 80 mol %. The raw materials were pulverized in a wet media mill for 2 hours to prepare a slurry. The slurry thus obtained was dried with a spray dryer to obtain spherical particles. These particles were subjected to particle size control, and then maintained at 1250° C. in an oxygen concentration of approximately 21% by volume (sintering in the air) for 4 hours for sintering. Thereafter, the substance subjected to sintering was disintegrated and further classified for particle size control, and subjected to removal of low magnetic strength portions by magnetic separation to yield a core material for ferrite particles.

Resin-coated ferrite carrier particles were obtained in the same manner as in Example 1 in the step for resin coating and thereafter.

Here, the above-described blending composition is represented by $(Li_2O)_{13.3}(MgO)_{6.7}(Fe_2O_3)_{80}$; thus, when this composition is calculated as a mixture composed of the Li ferrite having the stoichiometric composition and the Mg ferrite having the stoichiometric composition, a stoichiometric ferrite composed of $(Li_2O)$ and $(Fe_2O_3)$ in proper proportions leads to a composition that $[(Li_2O)_{13.3}(Fe_2O_3)_{66.5}]$ $[(MgO)_{6.7}(Fe_2O_3)_{6.7}]$, so that $(Fe_2O_3)$ is found to be excessive by 80−66.5−6.7=6.8 mol %.

COMPARATIVE EXAMPLE 2

Raw materials were weighed out so as to give the composition composed of $Li_2O$: 13.3 mol %, MgO: 6.7 mol % and $Fe_2O_3$: 80 mol %. Resin-coated ferrite carrier particles were obtained in the same manner as in Comparative Example 1 except that 3.5 parts by weight of trimanganese tetraoxide was added to 100 parts by weight of the mixture obtained by mixing these weighed raw materials.

COMPARATIVE EXAMPLE 3

Individual raw materials were mixed so as to be as close as possible to Example 1 of Japanese Patent Laid-Open No. 2006-154806. Here, lithium carbonate was used as a raw material in place of LiO and magnesium hydroxide was used as a raw material in place of MgO. Additionally, to 100 mol of the above-described composition, CuO: 0.002 mol and MnO: 0.02 mol were added, and the mixture thus obtained was pulverized with a wet ball mill for 5 hours, dried, and then maintained at 850° C. for 1 hour for calcining. Thereafter, the calcined substance was pulverized with a wet ball mill for 7 hours, then added with a dispersant and a binder (PVA), and granulated with a spray dryer. The thus obtained particles were maintained in an electric furnace at 1200° C. with an oxygen concentration of 21% by volume (sintering in the air) for 4 hours for sintering. Thereafter, the substance subjected to sintering was disintegrated and further classified for particle size control, and then subjected to removal of low magnetic strength portions by magnetic separation to yield a core material for ferrite particles.

The ferrite particles thus obtained were coated with resin in the same manner as in Example 1 to yield resin-coated ferrite carrier particles.

The compositions of the thus obtained ferrite carrier particles are shown in Table 1. Additionally, the specific surface areas of the ferrite particles (carrier core material), and the various properties of the resin-coated ferrite carrier particles (volume average particle size, number average particle size, the content of the particles of less than 24 μm in particle size, electrical resistance, apparent density, true density, surface property variation among particles, magnetic properties, and scattering test results) are shown in Table 2 and Table 3. The evaluation methods of the individual properties are as described above.

TABLE 1

| | Composition (mol %) | | | Li content | Mn content | Content of elements other than Fe, Mg, Li and O, inclusive | Excessive composition (calculated) | |
|---|---|---|---|---|---|---|---|---|
| | $Li_2O$ | MgO | $Fe_2O_3$ | (wt %) | (ppm) | of Mn (wt %) | In terms of $Li_2O$ + MgO (mol %) | In terms of $Fe_2O_3$ (mol %) |
| Example 1 | 15.0 | 5.0 | 80.0 | 1.55 | 2500 | 0.35 | None | None |
| Example 2 | 12.5 | 12.5 | 75.0 | 1.34 | 2100 | 0.28 | None | None |
| Example 3 | 10.0 | 20.0 | 70.0 | 1.13 | 1700 | 0.24 | None | None |
| Example 4 | 15.0 | 5.0 | 80.0 | 1.54 | 4400 | 0.51 | None | None |
| Comparative Example 1 | 13.3 | 6.7 | 80.0 | 1.28 | 2800 | 0.37 | — | 6.8 |
| Comparative Example 2 | 13.3 | 6.7 | 80.0 | 1.31 | 12000 | 2.10 | — | 6.8 |
| Comparative Example 3 | 10.2 | 6.7 | 83.1 | 0.98 | 2600 | 0.48 | — | 41.9 |

TABLE 2

| | Volume average particle size (μm) | Number average particle size (μm) | Content of particles of less than 24 μm in particle size (vol %) | Electrical resistance (Ω) at 100 V | Apparent density (g/cm$^3$) | True density (g/cm$^3$) | BET specific surface area of core material particles (m$^2$/g) |
|---|---|---|---|---|---|---|---|
| Example 1 | 35.6 | 28.1 | 1.2 | 1.1E12 | 1.70 | 3.83 | 0.427 |
| Example 2 | 36.5 | 29.3 | 1.2 | 1.7E12 | 1.50 | 3.84 | 0.564 |
| Example 3 | 38.4 | 29.2 | 1.2 | 9.4E11 | 1.82 | 3.97 | 0.224 |
| Example 4 | 36.1 | 29.1 | 1.4 | 1.1E12 | 1.57 | 3.78 | 0.500 |
| Comparative Example 1 | 35.1 | 26.7 | 4.5 | 6.7E9 | 2.26 | 4.92 | 0.086 |
| Comparative Example 2 | 33.2 | 25.3 | 5.2 | 7.0E9 | 2.25 | 4.89 | 0.090 |
| Comparative Example 3 | 38.9 | 24.2 | 6.2 | 2.5E9 | 2.30 | 4.79 | 0.279 |

TABLE 3

| | Surface property | Magnetic properties | | | Scattering test | |
|---|---|---|---|---|---|---|
| | variation among particles | Saturation magnetization (Am$^2$/kg) | Remanent magnetization (Am$^2$/kg) | Coercive force (Oe) | Scattered amount (mg) | Magnetization of scattered substance (Am$^2$/kg) |
| Example 1 | ◎ | 64 | 2 | 10 | 15.4 | 63 |
| Example 2 | ◎ | 55 | 2 | 12 | 20.2 | 54 |
| Example 3 | ○ | 50 | 3 | 15 | 22.3 | 48 |
| Example 4 | ○ | 62 | 2 | 10 | 16.8 | 61 |
| Comparative Example 1 | Δ | 61 | 2 | 12 | 80.9 | 42 |
| Comparative Example 2 | X | 61 | 3 | 15 | 102.5 | 33 |
| Comparative Example 3 | X | 44 | 3 | 15 | 160.4 | 15 |

As can be clearly seen from Table 4, the resin-coated ferrite carriers of Examples 1 to 4 exhibit satisfactory results for the scattering test indicating the magnetic property variation among particles, and additionally, are small in the surface property variation among particles to give satisfactory results.

On the other hand, the resin-coated ferrite carriers containing $Fe_2O_3$ in excess (Comparative Examples 1 and 3), and the resin-coated ferrite carrier large in the Mn content (Comparative Example 2) are extremely large in the surface property variation among particles and the magnetic property variation among particles.

INDUSTRIAL APPLICABILITY

The ferrite carrier for electrophotographic developer according to the present invention is light in specific gravity, high in electrical resistance, and small in the variation of various properties such as the electrical resistance properties, magnetic properties and surface property. Additionally, the electrophotographic developer according to the present invention using this ferrite carrier is high in durability, high in reliability and resistant to leakage generation even in a high electric field, and hence low in image defects.

As described above, the present invention can be suitably applied to the two-component developer used in electrophotography.

What is claimed is:

1. A ferrite carrier for electrophotographic developer wherein:

the ferrite carrier is a composite ferrite comprising Li and Mg;

when the composition of the ferrite is calculated as a mixture of a Li ferrite having a stoichiometric composition and a Mg ferrite having a stoichiometric composition, the excessive amount of $Fe_2O_3$ is less than 5 mol %, or the total excessive amount of $Li_2O$ and MgO is less than 1 mol %;

the content of the elements other than Li, Mg, Fe and O is 2% by weight or less; and further, the content of Mn in terms of element is 1000 to 9000 ppm.

2. The ferrite carrier for electrophotographic developer according to claim 1, in which the content of Li is 0.60 to 1.65% by weight.

3. The ferrite carrier for electrophotographic developer according to claim 1, in which the specific surface area is 0.05 to 0.70 m$^2$/g.

4. The ferrite carrier for electrophotographic developer according to claim 1, the surface of which is coated with a resin.

5. The ferrite carrier for electrophotographic developer according to claim 1, in which the volume average particle size is 20 to 50 μm, the number average particle size is 15 to 40 μm, the content of the particles of less than 24 μm in particle size is 5% by volume or less, the true density is 3.0 to 5.0 g/cm$^3$, and an apparent density is 1.0 to 2.2 g/cm$^3$.

6. An electrophotographic developer comprising the ferrite carrier according to claim 1 and a toner.

* * * * *